United States Patent [19]

Reneau et al.

[11] Patent Number: 4,878,160

[45] Date of Patent: Oct. 31, 1989

[54] OUTDOOR LIGHTPOLE

[76] Inventors: George W. Reneau, 6130 E. Orange St., Indianapolis, Ind. 46203; George M. Reneau, 7845 Cullen Dr., Indianapolis, Ind. 46219

[21] Appl. No.: 167,095

[22] Filed: Mar. 11, 1988

[51] Int. Cl.[4] ..... F21V 21/26

[52] U.S. Cl. ..... 362/269; 362/431

[58] Field of Search ..... 362/269, 427, 429, 430, 362/431

[56] References Cited

U.S. PATENT DOCUMENTS

| | | | |
|---|---|---|---|
| 1,903,907 | 4/1933 | Riemenschneider | 362/431 |
| 1,906,508 | 5/1933 | Arbogast | 362/431 |
| 3,364,635 | 1/1968 | Guggemos | 362/431 |
| 3,508,731 | 4/1970 | Jablonski | 362/431 |
| 3,671,738 | 6/1972 | Beachley | 362/431 |
| 4,507,715 | 3/1985 | Wedding | 362/431 |

FOREIGN PATENT DOCUMENTS

| | | | |
|---|---|---|---|
| 1202183 | 1/1968 | United Kingdom | 362/431 |

*Primary Examiner*—Ira S. Lazarus
*Assistant Examiner*—Sue Hagarman
*Attorney, Agent, or Firm*—Robert A. Spray

[57] ABSTRACT

A servicepole assembly, particularly for a pole such as a lightpole which carries a light or display which needs periodic servicing or replacement of lights, for mounting on a stable foundation pad. The assembly includes a hinged pair of support members, one adjustably connected to the support pad and one connected to the lightpole; and the support members are releasably connected together, to provide either a stable support of the pole in erect condition or to permit the pole to be swung downwardly to provide convenient access for service or other maintenance.

Other features include a 2-portion pole, splined for rotatability of the light unit's support arm, hollowness of the pole with the accommodation of wiring to be interior of the pole, a hinged door on the pole to accommodate access to the terminal block and the light's ballast unit, etc.

12 Claims, 2 Drawing Sheets

OUTDOOR LIGHTPOLE

FIELD OF THE INVENTION

The present invention relates to servicepoles, and more particularly as herein presented to lightpoles whose height of carry of their lights or other displays makes for difficult or expensive maintenance.

Still more particularly, the present invention relates to and provides servicepole or lightpole devices and installations of novel nature, having self-contained adaptations providing not only the convenience of easy installations, vertical plumbness of the pole, etc., but achieves such advantages with also the provision of ease of servicing or other maintenance tasks for the lights or other displays being carried atop the pole.

The novel nature of the invention provides the particular advantage that the user may easily release certain erection-holding features of the installation, and then swing or rotate the pole downwardly to provide easy access to the pole's lights, for easy and economical maintenance, etc.

PRIOR ART INSTALLATIONS DO NOT PROVIDE THE PARTICULAR ADVANTAGES AND CHARACTERISTICS HERE ACHIEVED:

In considering the nature of the servicepole and its support concepts, and contrasting the inventive nature of the present concepts over prior art servicepoles as known to the inventors, it is not only conceded but emphasized that there are prior art servicepoles which would and do quite effectively support lights or other displays; and such servicepoles are in use by the millions.

However, such servicepole or lightpoles of the prior art, including any of current use known to the inventors, all have disadvantages nicely avoided by the present invention. That is, they do not provide the easy of installation or of light maintenance which provide special and particular advantages of the present invention.

Moreover, such prior art pole installations fail to provide the present invention's advantages, particularly of the combination of various features and details of the invention, providing easily the full and properly vertical orientation of the pole, and its convenient swing-nature lowering of its lights-display for periodic maintenance.

THE PRESENT INVENTION, SUMMARIZED:

It is against the background of such prior art of scores of years, which fails to provide the advantages of installation or the advantageous use here shown to be achieved by the present concepts, that the concepts of the present servicepole device and installation are rightly and realistically to be considered.

Especially providing advantage for such labor-saving and convenient use, providing the advantages of both installation and use herein mentioned, the inventive concepts may be considered as summarized as servicepoles having novel provisions of both installation and swing-down lowering, by novel features including a pair of relatively rotatable support plate members, one connected to the installation's support pad and one connected to the lightpole, with releasable holding features which when released permit the lightpole to be swung or rotated to bring its lights or other display down for convenient access to a person standing on the ground, thus achieving convenience of servicing or other maintenance. Other features add to the overall desirability.

By the features thus summarized, and particularly by them in their effort as a combination, and in contrast to the prior art known to the inventors and to what even by hindsight might be asserted as suggestions from the prior art, the present invention provides an advantageous and novel servicepole device and installation for providing ease of installation and use, particularly advantageous when the difficulties of periodic servicing and other maintenance tasks are considered.

Accordingly, although various separate concepts and components of servicepole and lightpoles are conceded and emphasized to have been widely known in the prior art even in installations the world over, for scores of years, nevertheless, the prior art not having had the particular concepts and details as here presented and as shown as different from the prior art as to the vitally-significant factor of the overall combination, even only a fair amount of realistic humility, to avoid consideration of this invention improperly by hindsight, requires the concepts and the advantageous achievement to be realistically viewed as inventive in their nature.

BRIEF DESCRIPTION OF THE DRAWINGS:

The above description of the novel and advantageous servicepole device of the present invention is of somewhat introductory and generalized form. More particular details, concepts, and features are set forth in the following and more detailed description of an illustrative embodiment, taken in conjunction with the accompanying drawings, which are of somethat schematic and diagrammatic nature, for showing the inventive concepts of the present invention as are illustrated in this embodiment.

FIG. 2 is a plan view of a base plate member;

FIG. 3 is a plan view of a hinged support member which rests upon, and is hingedly secured to, the base member of FIG. 2;

FIG. 4 is a view of a bolt means which serves to hingedly interconnect the hinge plate of FIG. 3 with the base plate of FIG. 2;

FIG. 5 and 6 are both so-called half-section views with respect to the lightpole and the base plate and the hinge plate, illustrating details of construction; and in both views the generally hollow lightpole is shown as ensleeved onto the upper cylindrical support body of the hinge plate;

FIG. 5 is an elevation view showing the mounting of the base plate on an associated concrete post member, the hinge plate shown as supporting a lightpole, and the hinge plate and the lightpole being shown in a position of assembly or dis-assembly, i.e., in an intermediate "swing-down" position; and FIG. 6 is a view similar to FIG. 5, except that the hinge plate and the lightpole are now vertical orientation as they would be in use, and with the hinge plate clamped to the base plate; and in this view, a bolt cover is indicated by a fragmental detail.

Figures 1, 2, 3, 4:
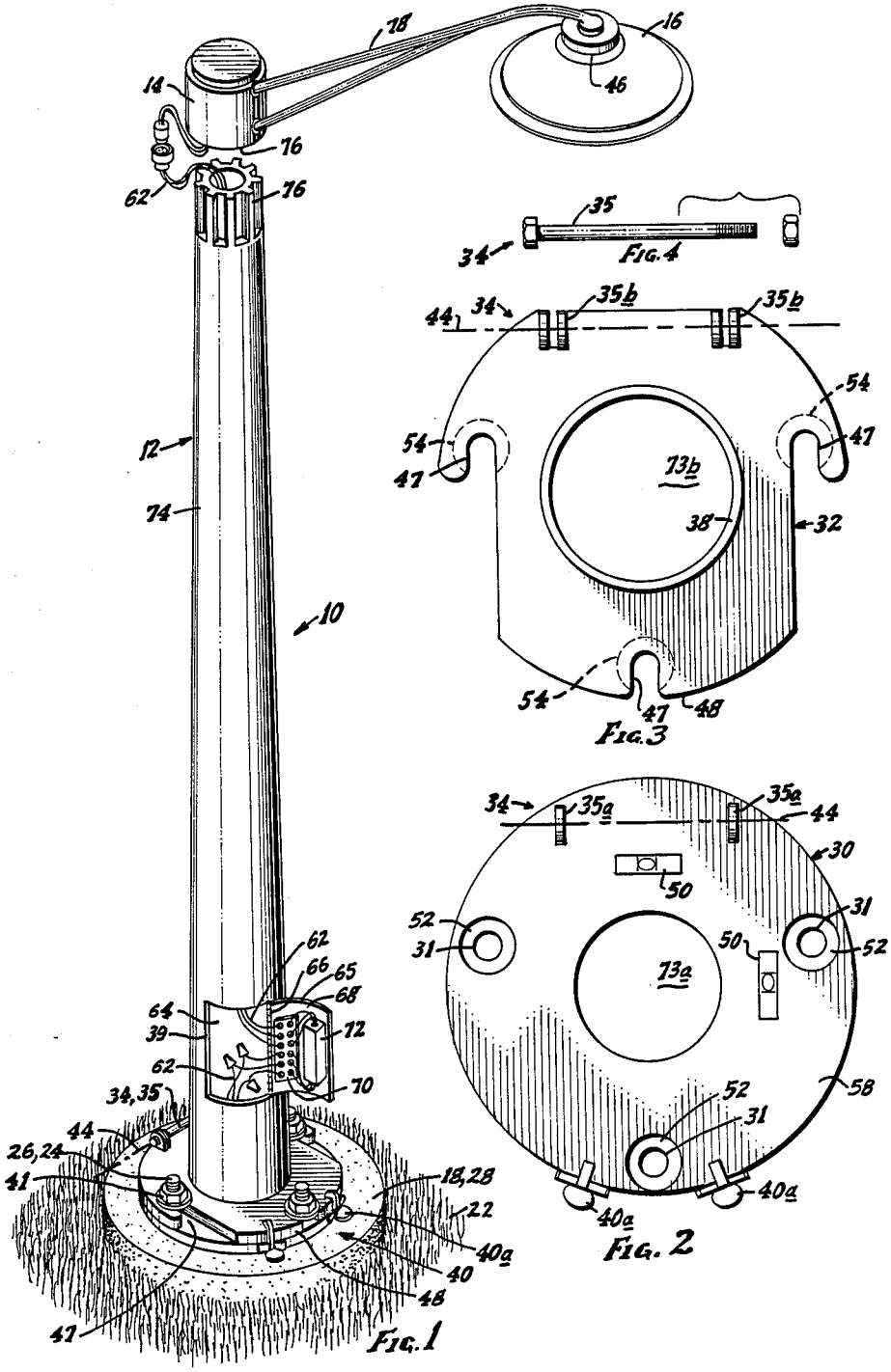
FIG. 1 is a pictorial elevation view of a lightpole illustrating concepts of the invention, an upper portion being shown in a dis-assembled state in the nature of an exploded view, and with a lower access door shown as swung open to illustrate details of circuitry housed within the hollow lightpole.
FIGS. 2–6, in considerably larger scale, are detailed views of features shown in the lightpole of FIG. 1, and more particularly.

DESCRIPTION OF PREFERRED EMBODIMENT OF THE INVENTION:

As shown in the drawings, the present invention provides a servicepole assembly 10, here shown as for a pole shown as a lightpole 12 carrying adjacent its top end 14 an electric light unit 16.

The concepts particularly provide a novel and advantageous mounting of the lightpole 12 on a mounting or stable foundation pad 18, providing advantages as specified herein, it being assumed that the pad is a concrete unit formed into a hole 20 in the ground 22, and with retention bolts 24 carried by the foundation pad 18 in a well-known construction manner, i.e., with the bolt-heads 25 encapsulated in the concrete of the pad 18, and with the threaded bolt-shanks 26 extending vertically, and upwardly of the top 28 of the foundation pad 18.

The assembly 10, considering its components upwardly from the pad 18 and the pad-top 28, is shown as having a plate-like fixed support means 30, with the bolts 24 providing what may be called first holding means 24 which hold the fixed support means 30 to the pad 18 and with the fixed support plate means 30 being supported thereby, in an adjustable manner described more in detail herein.

The lower support plate 30 is provided with openings 31 through which the bolt shanks 26 extend.

The assembly 10 also includes a plate-like member here called a secondary support means 32; and there are shown hinge means 34 which rotatably connect the fixed support plate means 30 and the secondary support plate means 32, with operativity described herein for advantage in the installation and use of the lightpole 12 and for servicing of the light unit assembly 16. The hinge 34 is shown as comprising a hinge bolt 35, which passes through aligned openings in ears **35*a* and 35*b*, respectively, of support plates 30 and 32**.

There is shown a connection means 36 here shown as a sleeve-like post or cylinder 38 for fixedly connecting the lightpole 12 to the secondary support plate means 32, the lightpole 12 being hollow, and its cylindrical wall 39 tightly fitting over the post 38.

There is also shown second holding means 40, here a pair of clamp arms **40*a* and nuts 41 for the bolt shanks 26, for releasably holding the lightpole 12 and the secondary support plate means 32 to the fixed support plate means 30; and, with there being the connecting hinge 34, and with the two plate-members 30 and 32 having generally flat surfaces, the second holding means 40 holds the lightpole 12 and the upper support plate 32, as a unit, in a specific relative orientation, relatively to the lower plate 30**.

However, the connector clamps **4*a* and the nuts 41 are releasable, accommodating relative rotation of the fixed support plate means 30 and the secondary support plate means 32; and this relative rotatability (about the axis 44 of hinge 34) thus permits downward swinging of the lightpole 12's upper end 14, thus facilitating the user's service, as the user stands on the ground 22 or on a service cart or the like, to whatever are components such as lamp unit 46 carried relatively adjacent the upper end 14 of the lightpole 12**.

It will be noted that the bolt-shanks 26 of the second holding means **40*a* includes a plurality of them, providing upstanding connector members for fixed connection to the fixed or lower support plate means 30; and the secondary or upper support plate means 32 is provided with openings 47 through which the bolt shanks 26** as connector members respectively extend.

Especially noticing FIG. 3, those openings 47 of the secondary or upper support plate means 32 are all provided to be of elongated nature with reference to the size of the connector bolts 24, in a direction perpendicular to the direction of the axis 44 of the hinge means 34; and that elongation of the holes 47 accommodates the rotation of the lightpole 12 for its servicing tasks. That elongation of the openings 47 of the secondary support plate 32 is such that the openings 47 extend fully to open at the outer edge 48 of the secondary support plate means 32, also facilitating installation as well as the swing-down rotation of the pole 12 about hinge-axis 44.

As shown, the second holding means 40 includes at least three of the upstanding connector members provided by the bolt-shanks 26, and they are positioned around the axis of the lightpole 12 such that all the connector member 26 are less than 180° apart with respect to the servicepole axis 49, assuring a stable connection.

As shown in FIG. 2 the fixed or lower support or base plate means 30 is advantageously provided with level-indicator means 50; and this provides that if the fixed or lower support plate means 30 is oriented with respect to the pad 18 the second holding means 40 assures selected orientation of the lightpole with respect to the pad 18, that selected orientation presumably although not necessarily being vertical.

It will be noted that both of the support plates 30 and 32 are provided with a recess, respectively 52 and 54, on their adjacent faces, accommodating a nut 56 which holds down the lower support plate 30 but providing that nut 56 does not prevent proper seating of the upper support plate 32 down onto the lower support plate 30 to achieve the desired relative orientation, and more particularly assuring the orientation of the secondary support plate means 32 and the axis 49 of lightpole 12 carried by it, with respect to the fixed support plate means 30 in spite of the presence of the nut 56 above the upper surface 58 of the fixed or lower support plate member 30. (This relates to all three bolts 24.)

The first holding means provided by the retention bolts 24 also includes a nut 60 screw-threadedly connected to each of the bolts 24 below the fixed or lower support plate means 30, the screw-threaded connection of the nut 60 to each of those bolts 24 providing not only a fixed locatability of the fixed or lower support plate means 30 as to the bolt means 24 and the pad 18 but also an adjustability of the relative orientation of all of the fixed or lower support base plate means 30, the secondary or upper support plate means 32 and the lightpole 12 with respect to the pad 18; and, being an initial or installation adjustment to the lower support plate 30, that adjustment provided by the nuts 60 probably will thereafter need no further adjustment.'

Figure 5:
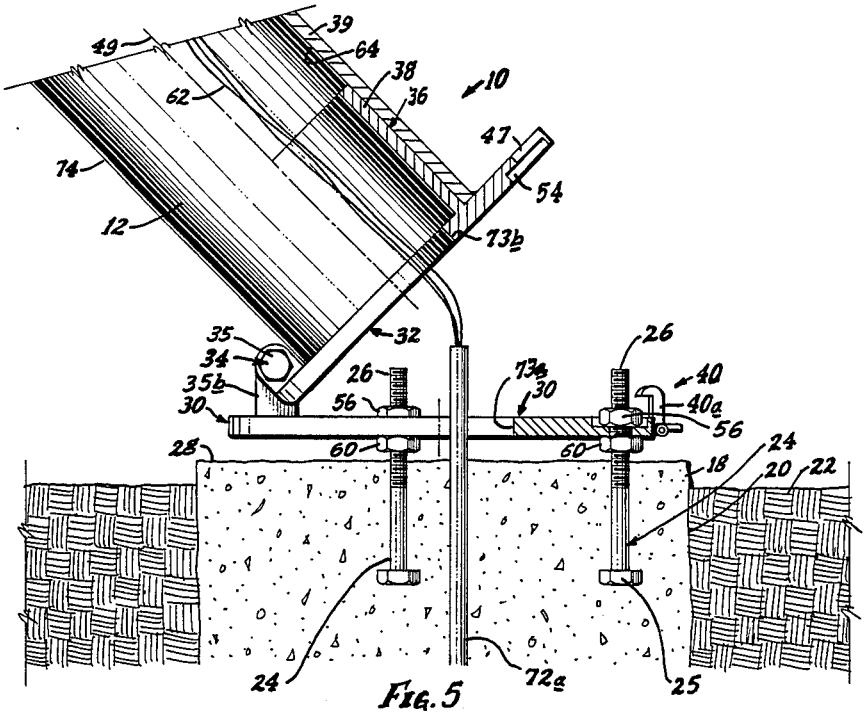
Figure 6:
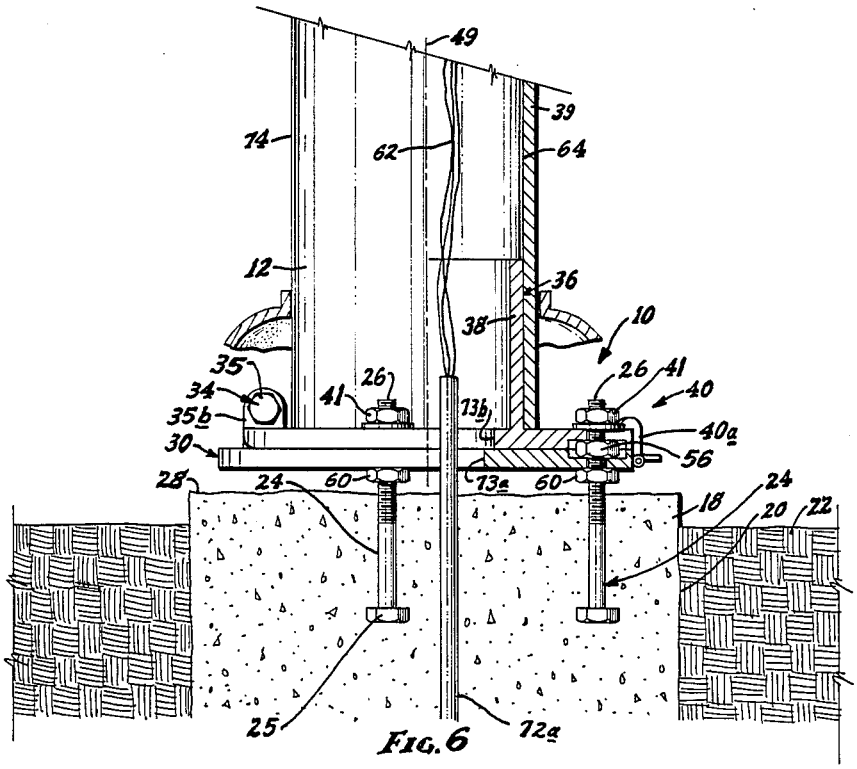

As shown in FIGS. 1, 5, and 6, the servicepole 12 is hollow, and the wiring 62 for the light unit or service outlet 16, 46 which is carried by the lightpole 12 is located in the hollow interior 64 of the lightpole 12.

Illustrated in FIG. 1, a portion 65 of the wall 39 of the servicepole 12 is shown as movable, here by a hinge 66 to expose its interior face 68; and a terminal board 70 is shown mounted onto the interior face 68 of the movable portion 65 of the wall 39 of the servicepole 12.

The circuitry 62 for the service outlet 16, 46 which is carried by the lightpole includes a ballast unit 72, and the ballast unit 72 is mounted onto the interior face 68 of the movable portion 65 of the wall 39 of the lightpole 12.

For accommodating the wiring 62, as it comes from conduit 72*a*, through the pad 18 and then to the lightpole 12, the plates 30 and 32, respectively, are shown as provided with central cut-outs or openings 73*a* and 73*b* respectively.

Also of advantage is the feature that the lightpole 12 includes a pair of portions, i.e., a first or upper portion 14 already mentioned as carrying the service outlet 16/46, and a second or lower portion 74 which is the portion of the lightpole which is connected by the connection means 36 to the secondary or upper support plate means 32; and those portions 14/74 of the lightpole 12 are provided along their adjacent portions with a splined interconnection means 76 which not only provide fixed support of the servicepole's upper portion 14 but rotational adjustability of the service outlet 16/46 with respect to the axis of the lightpole 12 (axis 49) by relative rotation of the arm 78 carrying the light or other service outlet 16/46 with respect to the upper pole-portion 14.

CONCLUSION:

It is thus seen that a servicepole device or installation, constructed and used according to the inventive concepts herein set forth, provides novel concepts of a desirable and usefully advantageous device, yielding advantages which are and provide special and particular advantages when used for the provision of a high-height carry of lights or other displays which require periodic change, replacements or other maintenance servicing tasks.

In summary as to the nature of the overall device's advantageous concepts, their novelty and inventive nature is shown by novel features of concept and construction shown here in advantageous combination and by the novel concepts hereof not only being different from all the prior art known, even though servicepoles and lightpoles of many forms have been known for scores of years, but because the achievement is not what is or has been suggested to those of ordinary skill in the art, especially realistically considering this as a combination comprising components which individually are similar in nature to what is well known to most all persons, surely including most of the many makers and users of servicepole components and installations, for untold number of years, throughout the entire world. No prior art component or element has even suggested the modifications of any other prior art to achieve the particulars of the novel concepts or the overall combination here achieved, with the special advantages which the overall device provides; and this lack of suggestion by any prior art has been in spite of the world wide use of lightpoles ever since electricity has been used, with its requirements of delivery, and with the replacement needs of the lights carried by the lightpoles, all for untold number of years and in untold numbers of situations.

The differences of concept and construction are specified herein, yielding advantages needed for scores of years, during all of which this present invention has not been suggested to or by the millions and millions of user for which this invention would have been advantageous. All of that lack of this invention by all those millions has been in spite of the simplicity of the construction once the concepts have been conceived, in spite of the advantages it would have given, and in spite of the availability of all the materials, to all persons the entire world over.

Quite certainly this particular combination of prior art details as here presented in this overall combination has not been suggested by the prior art, this achievement in its particular details and utility being a substantial and advantageous departure from prior art, even though the prior art has had the components in a separate state for a multiplicity of uses for these many years. And particularly is the overall difference from the prior art significant when the non-obviousness is viewed by a consideration of the subject matter of this overall device as a whole, as a combination integrally incorporating features different in this combination from the prior art, in contrast to merely separate details themselves, and further in view of the prior art servicepole or lightpole concepts and devices not achieving particular advantages here achieved by this combination.

Accordingly, it will thus be seen from the foregoing description of the invention according to this illustrative embodiment, considered with the accompanying drawings, that the present invention provides new and useful concepts of a novel and advantageous servicepole device having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

What is claimed is:

1. A servicepole assembly, for mounting a servicepole on a mounting foundation pad, comprising;
   - a fixed support means, with first holding means which hold the fixed support means to the pad and supported thereby;
   - a secondary support means;
   - hinge means rotatably connecting the fixed support means and the secondary support means;
   - a servicepole;
   - connection means for fixedly connecting the servicepole to the secondary support means;
   - second holding means for releasably holding the servicepole and the secondary support means to the fixed support means, and in a specific relative orientation, but releasable for accommodating relative rotation of the fixed support means and the secondary support means, to thereby permit downward swinging of the servicepole's upper end to facilitate service in a region adjacent the ground, to whatever are components carried relatively adjacent the upper end of the servicepole,
   - in which the second holding means includes a plurality of upstanding connector members for fixed connection to the fixed support means, and the secondary support means is provided with openings through which the connector members respectively extend, and the said openings of the secondary support means are provided to be of elongated nature with reference to the size of the connector members in a direction perpendicular to the direction of the axis of the hinge means, thereby accommodating the rotation of the servicepole for its said servicing, and in which the elongation of the openings of the secondary support means is such that the openings extend fully to open at the outer edge of the secondary support means.

2. The invention as set forth in claim 1 in a combination in which the secondary means is a plate member.

3. The invention as set forth in claim 1, in a combination in which the fixed support means is provided with level-indicator means, providing that if the fixed support means is oriented with respect to the pad the second holding means assures selected orientation of the servicepole with respect to the pad.

4. The invention as set forth in claim 1, in a combination in which the first holding means including a bolt means fixed to the pad, and extending upwardly of the fixed support means, and a nut screw-threadedly connected to the bolt means above the fixed support means.

5. The invention as set forth in claim 4, in a combination in which the secondary support means is provided with a recess on its lower surface, accommodating the said nut and assuring the orientation of the secondary support means and the servicepole with respect to the fixed support means in spite of the presence of the nut above the upper surface of the fixed support member.

6. The invention as set forth in claim 4, in a combination in which the first holding means also includes a nut means screw-threadedly connected to the bolt means below the fixed support means, the screw-threaded connection to the bolt means providing not only a fixed locatability to the fixed support means to the bolt means and the pad but also an adjustability of the relative orientation of the fixed support means, the secondary support means, and the servicepole with respect to the pad.

7. The invention as set forth in claim 1, in a combination in which the servicepole is hollow, and wiring for the service outlet which is carried by the servicepole is located in the hollow interior of the servicepole.

8. The invention as set forth in claim 7, in a combination in which a portion of the wall of the servicepole is movable to expose its interior face.

9. The invention as set forth in claim 8, in a combination in which a terminal board is mounted onto the interior face of the movable port of the wall of the servicepole.

10. The invention as set forth in claim 8, in a combination in which the circuitry for the service outlet which is carried by the servicepole includes a ballast unit, and the ballast unit is mounted onto the interior face of the movable portion of the wall of the servicepole.

11. The invention as set forth in claim 1, in a combination in which the servicepole includes a pair of portions, a first portion carrying the service outlet and a second portion which is the portion of the servicepole which is connected by the connection means to the secondary support means, and the first portion and the second portion of the servicepole are provided along their adjacent portions with a splined interconnection means which not only provide fixed support of the servicepole's first portion but rotational adjustability of the service outlet with respect to the axis of the servicepole.

12. A servicepole assembly, for mounting a servicepole on a mounting foundation pad, comprising;

a fixed support means, with first holding means which hold the fixed support means to the pad and supported thereby;

a secondary support means;

hinge means rotatably connecting the fixed support means and the secondary support means;

a servicepole;

connection means for fixedly connecting the servicepole to the secondary support means;

second holding means for releasably holding the servicepole and the secondary support means to the fixed support means, and in a specific relative orientation, but releasable for accommodating relative rotation of the fixed support means and the secondary support means, to thereby permit downward swinging of the servicepole's upper end to facilitate service in a region adjacent the ground, to whatever are components carried relatively adjacent the upper end of the servicepole, and in which the second holding means are three outstanding connector members, positioned around the axis of the servicepole such that all connector members are less than 180° apart with respect to the servicepole axis.

* * * * *